US005672570A

United States Patent [19]

Miyaji et al.

[11] Patent Number: 5,672,570

[45] Date of Patent: *Sep. 30, 1997

[54] LUBRICATING OIL COMPOSITION FOR DIESEL ENGINE AND METHOD FOR LUBRICATION OF DIESEL ENGINE USING SAME

[75] Inventors: Tomomi Miyaji; Masahisa Goto; Keiich Narita, all of Ichihara, Japan

[73] Assignee: Idemitsu Kosan Co., Ltd., Tokyo, Japan

[ * ] Notice: The term of this patent shall not extend beyond the expiration date of Pat. No. 5,525,247.

[21] Appl. No.: 581,219

[22] Filed: Dec. 29, 1995

Related U.S. Application Data

[63] Continuation of Ser. No. 288,902, Aug. 11, 1994, Pat. No. 5,525,247.

[30] Foreign Application Priority Data

Aug. 11, 1993 [JP] Japan ..... 5-199497

[51] Int. Cl.[6] ..... C10M 141/12; C10M 159/20; C10M 159/22; C10M 159/24

[52] U.S. Cl. ..... 508/192; 508/502

[58] Field of Search ..... 252/18; 508/192, 508/502

[56] References Cited

U.S. PATENT DOCUMENTS 3,282,842 11/1966 Bonner ..... 252/51.5 R 5,141,657 8/1992 Fetterman, Jr. et al. ..... 252/48.2

5,525,247 6/1996 Miyaji et al. ..... 508/192

*Primary Examiner*—Jerry D. Johnson

*Attorney, Agent, or Firm*—Antonelli, Terry, Stout & Kraus, LLP.

[57] ABSTRACT

Disclosed are a lubricating oil composition for a diesel engine having a decreased ash content which can exert excellent engine detergency and deposit-resistant properties without impairing the performance of an exhaust gas post-treatment device such as a particulate exhaust matter trap or an oxidation catalyst, and a method for the lubrication of the diesel engine which comprises using this lubricating oil composition.

The present invention provides a lubricating oil composition for a diesel engine which is obtained by blending a lubricant base oil with (A) 5 to 20% by weight of a boron-containing ashless dispersant and (B) 0.01 to 30% by weight of metal-type detergents having a total base number of 0 to 200 mg KOH/g, based on the total weight of the composition, a sulfated ash content in the composition being 1.0% by weight or less, a boron content being 0.1% by weight or more, and a method for the lubrication of a diesel engine which comprises using the above-mentioned lubricating oil composition in a diesel engine provided with an exhaust gas post-treatment device.

7 Claims, 1 Drawing Sheet

LUBRICATING OIL COMPOSITION FOR DIESEL ENGINE AND METHOD FOR LUBRICATION OF DIESEL ENGINE USING SAME

This application is a continuation of application Ser. No. 288,902, filed Aug. 11, 1994 now U.S. Pat. No. 5,525,247.

BACKGROUND OF THE INVENTION

1. Field of the Invention

The present invention relates to a lubricating oil composition for a diesel engine and a method for the lubrication of a diesel engine using the same. More specifically, the present invention relates to a lubricating oil composition for a diesel engine having a decreased ash content which can exert excellent engine detergency and deposit-resistant properties without impairing the performance of an exhaust gas post-treatment device such as a particulate exhaust matter (PM) trap or an oxidation catalyst, and a method for the lubrication of a diesel engine which comprises applying the above-mentioned lubricating oil composition as a lubricating oil to the diesel engine provided with the exhaust gas post-treatment device.

2. Description of the Related Art

In recent years, measures to an environmental pollution with nitrogen oxides ($NO_x$), a particulate exhaust matter (PM) and the like in an exhaust gas from an internal combustion engine, particularly a diesel engine become important themes, and it is an urgent task to decrease the nitrogen oxides and the particulate exhaust matter in the exhaust gas.

As these measures, for the decrease in $NO_x$, it has be investigated to lower a combustion peak temperature by heightened exhaust gas recycling (EGR) ratio or retarded fuel-injection timing.

However, if the combustion peak temperature is lowered, black smoke and PM increase, and so the installation of an exhaust gas post-treatment device is necessary. As this exhaust gas post-treating device, a PM trap or an oxidation catalyst has been investigated, but both of them have filter structures. Therefore, when a conventional diesel engine oil is used, the problem of clogging (closing) with metals in the oil takes place.

Furthermore, the decrease in the metal content in the oil (the decrease in metal-type detergents) causes the deterioration of detergency, and hence, in order to maintain the present detergency, the development of a novel lubricating oil for the internal combustion engine has been desired.

SUMMARY OF THE INVENTION

An object of the present invention is to provide a lubricating oil composition for a diesel engine having a decreased ash content which can exert excellent engine detergency and deposit-resistant properties without impairing the performance of exhaust gas post-treatment device such as a particulate exhaust matter (PM) trap or an oxidation catalyst. Another object of the present invention is to provide a method for the lubrication of a diesel engine by the use of this lubricating oil composition.

Thus, the present inventors have intensively researched to achieve the above-mentioned objects, and as a result, it has been found that these objects can be achieved by a lubricating oil composition which contains a boron-containing ashless dispersant, metal-type detergents having a specific total bese number, and in a certain case, an ester having a specific structure at a predetermined ratio and in which a sulfated ash content and a boron content are in predetermined ranges. The present invention has been completed on the basis of such a knowledge.

That is to say, the present invention provides a lubricating oil composition for a diesel engine which is obtained by blending a lubricant base oil with (A) 5 to 20% by weight of a boron-containing ashless dispersant and (B) 0.01 to 30% by weight of at least one kind of metal-type detergent selected from the group consisting of sulfonates, phenates and salicylates having a total base number (a perchloric acid method) of 0 to 200 mg KOH/g, based on the total weight of the composition, a sulfated ash content in the composition being 1.0% by weight or less, a boron content being 0.1% by weight or more.

In addition, the present invention provides a lubricating oil composition for a diesel engine which is obtained by blending a lubricant base oil with 5 to 20% by weight of the above-mentioned component (A), 0.01 to 30% by weight of the above-mentioned component (B), and (C) 0.1 to 30% by weight of an ester of an aromatic carboxylic acid having a hydroxyl group and an alcohol having 2 to 80 carbon atoms, based on the total weight of the composition, a sulfated ash content in the composition being 1.0% by weight or less, a boron content being 0.1% by weight or more.

Moreover, the present invention provides a method for the lubrication of a diesel engine which comprises the step of using the above-mentioned lubricating oil composition as a lubricating oil in a diesel engine provided with an exhaust gas post-treatment device.

PREFERRED EMBODIMENT OF THE PRESENT INVENTION

Figure 1:
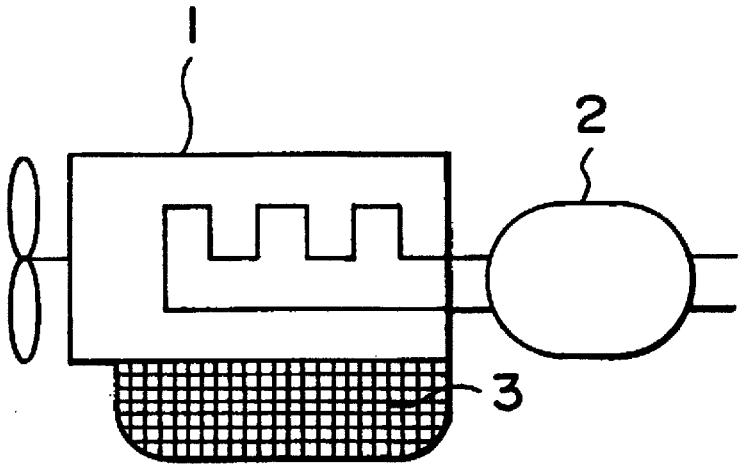
FIG. 1 is a schematic view for explaining a lubrication method of a diesel engine of the present invention, and in this drawing, reference numeral 1 is a diesel engine, numeral 2 is an exhaust gas post-treating device, and 3 is a lubricating oil.

As a base oil in a lubricating oil composition of the present invention, a mineral oil or a synthetic oil is usually used. No particular restriction is put on the kind and the like of mineral oil or synthetic oil, but the mineral oil or the synthetic oil having a kinemetic viscosity at 100° C. in the range of 1.5 to 30 cSt is usually used.

Here, examples of the mineral oil include paraffinic mineral oils, intermediate mineral oils and naphthenic mineral oils which can be obtained by a usual purification method such as a solvent purification or a hydrogenated purification.

Furthermore, examples of the synthetic oil include polybutene, polyolefin [α-olefin (co)polymer], various kinds of esters (e.g., polyol esters, dibasic acid esters and phosphates), various kinds of ethers (e.g., polyphenyl ethers), silicone oils, alkyl benzenes and alkyl naphthalenes.

In the present invention, as the base oil, the above-mentioned mineral oils may be used singly or in a combination of two or more thereof. Alternatively, the above-mentioned synthetic oils may be used singly or in a combination of two or more thereof. Moreover, a combination of one or more of the mineral oils and one or more of the synthetic oils may be used.

In the lubricating oil composition of the present invention, a boron-containing ashless dispersant may be used as a component (A). As this boron-containing ashless dispersant, there are various compounds, and examples of the usable boron-containing ashless dispersant include (1) a compound obtained by treating an alkenylsuccinimide or an alkylsuccinimide with a boron compound, (2) a compound obtained by treating an alkenylsuccinamide or an alkylsuccinamide with the boron compound, (3) a compound obtained by treating an alkenylbenzylamine or alkylbenzylamine with the boron compound, and (4) a compound obtained by treating a fatty acid amide with the boron compound.

The alkenylsuccinimide or an alkylsuccinimide in the above-mentioned (1) can be obtained by reacting an alkenylsuccinic anhydride or an alkylsuccinic anhydride, or an alkenylsuccinic acid or an alkylsuccinic acid with a polyamine. Here, the alkenyl group is formed from an olefin having 2 to 15 carbon atoms and having a molecular weight of 200 to 4,000, preferably 500 to 3,000, more preferably 700 to 2,300, and the preferable alkenyl group is a polyisobutenyl group. Alternatively, this alkenyl group may be hydrogenated to an alkyl group. Examples of the polyamine include polyalkylene polyamines, preferably polyethylene polyamines, and typical examples thereof include diethylenetriamine, triethylenetetramine, tetraethylenepentamine and pentaethylenehexamine. These polyamines may be used singly or in the form of a mixture of two or more thereof.

Furthermore, the alkenylsuccinimide or the alkylsuccinimide also include compounds formed by the Mannich condensation of this and an aromatic compound, and in particular, examples of the most suitable aromatic compounds include alkylphenols and sulfurized alkylphenols.

The usable alkyl group of the alkylphenol has 3 to 30 carbon atoms, and typical examples of the alkylphenol include butylphenol, octylphenol, nonylphenol, dodecylphenol, hexadecylphenol and eicosylphenol. In addition, the sulfurized alkylphenols are sulfides of alkylphenols.

As the above-mentioned alkenylsuccinimide, there can be preferably used a polybutenylsuccinimide which is a reaction product of polybutenyl succinic (anhydride) acid and polyethylene polyamine, its alkylphenol or a sulfurized alkylphenol derivative.

The alkenylsuccinamide or the alkylsuccinamide in the above-mentioned (2) can be obtained from an alkenylsuccinic acid or an alkylsuccinic acid and a polyamine. Here, examples of the alkenyl group and the alkyl group are the same as in the above-mentioned (1), and examples of the polyamine include the same compounds as mentioned in the above-mentioned (1). The polyamines may be used singly or in the form of a mixture of two or more thereof.

Examples of the alkenyl group of the alkenylbenzylamine in the above-mentioned (3) are the same as in the above-mentioned (1).

The fatty acid amide in the above-mentioned (4) can be obtained from a fatty acid and a polyamine, and as this fatty acid, there can be used a saturated or an unsaturated straight-chain or branched carboxylic acid having 8 to 22 carbon atoms. Examples of the polyamine are the same as mentioned in the above-mentioned (1). The polyamines may be used singly or in the form of a mixture of two or more thereof.

Examples of the boron compound used in the above-mentioned (1) to (4) include boric acid, boric anhydride, boron halides, boric acid esters, boric acid amides and boron oxides.

The thus obtained boron-containing ashless dispersant usually contains 0.05 to 4.0% by weight of boron, but in the present invention, it is preferable to use the dispersant in which boron is contained in the range of 0.5 to 2.2% by weight. Among the above-mentioned boron-containing ashless dispersants, the boron-containing alkenylsuccinimides and the boron-containing alkylsuccinimides are particularly preferable.

In the lubricating oil composition of the present invention, the boron-containing ashless dispersants which are the components (A) may be used singly or in a combination of two or more thereof. The amount of the boron-containing ashless dispersant to be blended is selected in the range of 5 to 20% by weight, preferably 6 to 15% by weight, more preferably 8 to 12% by weight on the basis of the total weight of the composition. If the amount of the boron-containing ashless dispersant is less than 5% by weight, its engine detergency is insufficient, and if it is more than 20% by weight, the viscosity of the lubricating oil composition rises and it becomes impractical.

In the lubricating oil composition of the present invention, as the metal-type detergent which is the component (B), there is used at least one selected from the group consisting of sulfonates, phenates and salicylates having a total base number [JIS-K-2501 (a perchloric acid method)] of 0 to 200 mg KOH/g, preferably 0 to 100 mg KOH/g.

Here, suitable examples of the sulfonates include alkaline earth metal salts of alkyl-substituted aromatic sulfonic acids, and compounds obtained by subjecting these alkaline earth metal salts to overbasification with an alkaline earth metal hydroxide or oxide and carbon dioxide.

Suitable examples of the phenates include alkaline earth metal salts of alkylphenol sulfides, and compounds obtained by subjecting these alkaline earth metal salts to overbasification with an alkaline earth metal hydroxide or oxide and carbon dioxide.

Additionally, preferable examples of the salicylates include alkaline earth metal salts of alkylsalicylic acids, and compounds obtained by subjecting these alkaline earth metal salts to overbasification with an alkaline earth metal hydroxide or oxide and carbon dioxide.

As the alkaline earth metal salts of the above-mentioned sulfonates, phenates and salicylates, there can be preferably used calcium salts, magnesium salts and barium salts.

These metal-type detergents may be used singly or in a combination of two or more thereof. Nevertheless, the selection of the phenate is particularly preferable, because the detergency can be improved.

In the metal-type detergents, if the total base number is more than 200 mg KOH/g, the sulfated ash content increases, and so the amount of the metal-type detergents to be blended is limited, so that the engine detergency deteriorates. The preferable total base number is in the range of 0 to 100 mg KOH/g.

In the lubricating oil composition of the present invention, the metal-type detergent which is the component (B) is required to be blended in a ratio of 0.01 to 30% by weight based on the total weight of the composition. If the amount of the metal-type detergent is less than 0.01 % by weight, its engine detergency is insufficient, and if it is more than 30% by weight, an inconvenient problem such as the clogging of the exhaust gas post-treatment device occurs. In the case that the ester of the component (C) which will be described hereinafter is not blended, the amount of this metal-type detergent to be blended is preferably in the range of 3 to 30% by weight, more preferably 3 to 15% by weight. Alternatively, in the case that the ester of the component (C) is blended, the amount of the metal-type detergent is suitably selected in the range of 0.01 to 30% by weight in compliance with the kind and the amount of this ester.

In the lubricating oil composition of the present invention, if desired, as the component (C), there can be blended an ester of an aromatic carboxylic acid having a hydroxyl group and an alcohol having 2 to 80 carbon atoms. This ester has a function as an ash-free detergent which is excellent in a high-temperature stability.

An example of the above-mentioned ester is obtained by reacting an alcohol having 2 to 80 carbon atoms with an aromatic carboxylic acid having a hydroxyl group represented by the general formula (I)

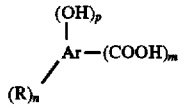

(I)

wherein Ar is a polyvalent aromatic nucleus; R is an organic group; p is an integer of 1 to 3; n is an integer of 1 to 4; m is an integer of 1 to 3; when n is plural, the plural Rs may be identical or different.

In the general formula (I), Ar denotes the polyvalent aromatic nucleus. Examples of this polyvalent aromatic compound can be derived from benzene, naphthalene, anthracene, phenanthrene, indene, fluorene and biphenyl. Among them, the compounds derived from benzene and naphthalene are particularly preferable. This Ar may be substituted by a hydroxyl group, an organic group (R) and a carboxyl group, and in some cases, it may be substituted by a halogen atom, a nitro group and a mercapto group.

R is the organic group, and examples of the organic group include hydrocarbon groups, alkoxy groups and dialkylamino groups, but the hydrocarbon groups are particularly preferable. When the plural Rs are present, they may be the same or different. No particular restriction is put on the kind of hydrocarbon groups, and examples of the hydrocarbon groups include chain hydrocarbon groups such as an alkyl group and an alkenyl group, cyclic hydrocarbon groups such as a cycloalkyl group and a cycloalkenyl group, and aromatic hydrocarbon groups such as a phenyl group and a naphthyl group, but chain hydrocarbon groups such as an alkyl group and an alkenyl group are preferable. These hydrocarbon groups may be substituted by another hydrocarbon group such as a lower alkyl group, a cycloalkyl group or a phenyl group. In addition, the hydrocarbon groups include hydrocarbon groups substituted by a non-hydrocarbon group, so long as they substantially keep up the characteristics of the hydrocarbon groups. Examples of this non-hydrocarbon group include a nitro group, an amino group, a halo group, a hydroxyl group, a lower alkoxy group, a lower alkylmercapto group, an oxo group, a thio group and cut-off groups (e.g., —NH—, —O— and —S—).

Typical examples of the preferable R include straight-chain and branched alkyl groups such as a hexyl group, a 1-methylhexyl group, a 2,3,5-trimethylheptyl group, an octyl group, a 3-ethyloctyl group, a 4ethyl-5-methyloctyl group, a nonyl group, a decyl group, a dodecyl group, a 2-methyl-4ethyldodecyl group, a hexadecyl group, an octadecyl group, an eicosyl group, a docosyl group and a tetracontyl group, and straight-chain and branched alkyl groups derived from olefin polymers (e.g., polyethylene, polypropylene, polyisobutylene and ethylene-propylene copolymer).

On the other hand, as the alcohol having 2 to 80 carbon atoms, there can be used aliphatic alcohols and aromatic alcohols as well as monovalent alcohols and polyvalent alcohols. Examples of the aliphatic alcohols include straight-chain or branched monovalent alcohols having 2 to 24 carbon atoms, and typical examples thereof include hexanol, octanol, decanol, dodecanol, tetradecanol, hexadecanol, octadecanol, oleyl alcohol, linolenyl alcohol, lauryl alcohol, myristyl alcohol, acetyl alcohol, stearyl alcohol, behenyl alcohol, a relatively higher synthetic monovalent alcohol which can be produced by an oxo process (e.g., 2-ethylhexyl alcohol), a relatively higher synthetic monovalent alcohol which can be produced by aldol condensation, or by oligomerization of an α-olefin (e.g., ethylene or propylene) in the presence of an organic aluminum catalyst and subsequent oxidation, cycloalkyl alcohols such as cyclopentanol, cyclohexanol and cyclododecanol, polyvalent alcohols, typically, such as ethylene glycol, propylene glycol, butylene glycol, pentylene glycol, hexylene glycol, heptylene glycol, 2-ethyl-1,3-trimethylene glycol, neopentyl glycol, diethylene glycol, relatively higher polyethylene glycol and polypropylene glycol, tripropylene glycol, dibutylene glycol, dipentylene glycol, dihexylene glycol, diheptylene glycol, sucroses of the general formula $HOCH_2(CHOCH)_nCH_2OH$ (e.g., glycerol, sorbitol and mannitol), pentaerythritol and its oligomers (e.g., dipentaerythritol and tripentaerythritol), and methylol polyols such as trimethylolethane and trimethylolpropane.

Examples of the aromatic alcohol include monovalent alcohols such as phenol, alkylphenols, naphthol and alkylnaphthols, divalent alcohols such as catechol, alkylcatechols, sulfurized alkylphenols and methylene-crosslinked alkylphenols, and trivalent alcohols such as trihydroxybenzene and trihydroxyalkylbenzenes.

As an alcohol component of this ester, an aromatic alcohol is preferable, and in particular, alkyl-substituted aromatic alcohols such as alkylphenols, alkylcatechols and trihydroxyalkylbenzenes are preferable in point of the performance of the obtained ester. Here, the alkyl group suitably has 1 to 24 carbon atoms, preferably 6 to 20 carbon atoms, and this alkyl group may have either a straight-chain structure or a branched structure and an aromatic ring may be substituted by 1 to 3 groups but preferably by 1 group.

In the present invention, typical examples of the ester which can be used as the component (C) include the following compounds:

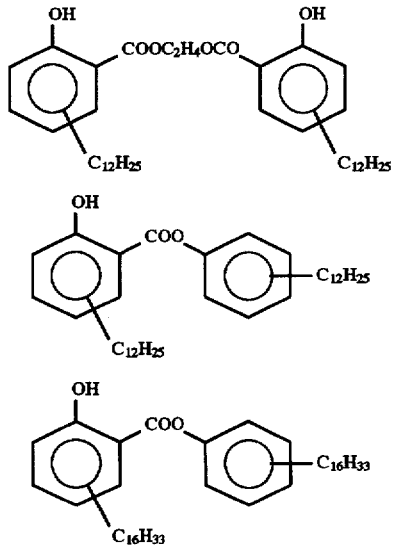

-continued

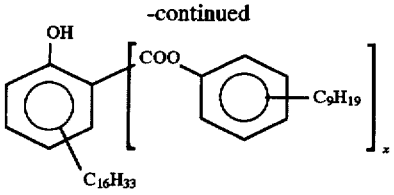

(x is an integer of 1 or 2)

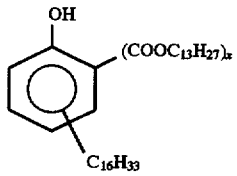

(x is an integer of 1 or 2)

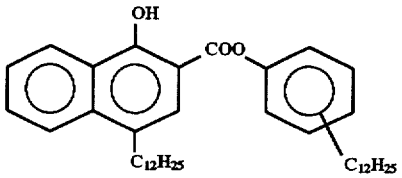

This ester of the component (C) may be used as it is, or it may be treated with a boron compound and then used as the ester having boron. Here, examples of the boron compound include boric acid, boric anhydride, boron halides, boric acid esters, boric acid amides and boron oxides.

In the lubricating oil composition of the present invention, these esters of the component (C) may be used singly or in a combination of two or more thereof.

Furthermore, the amount of the component (C) is selected in the range of 0.1 to 30% by weight, preferably 1 to 20% by weight on the basis of the total weight of the composition. If this amount is less than 0.1% by weight, the effect of the blended component (C) cannot be sufficiently exerted, and if it is more than 30% by weight, the viscosity of the composition at low temperatures rises inconveniently.

In the lubricating oil composition of the present invention, the sulfated ash content is 1.0% by weight or less, preferably 0.6% by weight or less. If the sulfated ash content is more than 1.0% by weight, an inconvenient problem such as the clogging of an exhaust gas post-treatment device tends to occur.

Moreover, in the lubricating oil composition, a boron content is 0.1% by weight or more, preferably in the range of 0.1 to 1.2% by weight, more preferably in the range of 0.1 to 0.4%, by weight. If this born content is less than 0.1% by weight, the engine detergency of the lubricating oil composition is not sufficiently exerted.

If necessary, other additives can be added to the lubricating oil composition of the present invention, so long as the objects of the present invention are impaired. Examples of the additives include an antiwear agent, an antioxidant, a viscosity index improver, a pour point depressant, a rust preventive, a metal corrosion inhibitor, an anti-foaming agent and a surface active agent.

Here, as the antiwear agent, there can be used materials containing zinc dithiophosphate (ZnDTP), zinc dithiocarbamate (ZnDTC) and sulfur compounds.

Examples of the ZnDTP-based antiwear agent include zinc primary alkyldithiophosphates, zinc secondary alkyldithiophosphates, alkyl-substituted zinc aryldithiophosphates and zinc aryldithiophosphates. Typical examples of the usable ZnDTP-based antiwear agent include zinc primary and secondary alkyldithiophosphates having a straight-chain group or a branched hydrocarbon group of 3 to 18 carbon atoms, and zinc aryldithiophosphates and alkyl-substituted zinc aryldithiophosphates having a phenyl group or an alkyl-substituted phenyl group of 1 to 18 carbon atoms.

Furthermore, examples of the ZnDTC-based antiwear agent include zinc primary alkyldithiocarbamates, zinc secondary alkyldithiocarbamates, alkyl-substituted zinc aryldithiocarbamates and zinc aryldithiocarbamates. Typical examples of the usable ZnDTC-based antiwear agent include zinc primary and secondary alkyldithiocarbamates having a straight-chain group or a branched hydrocarbon group of 3 to 18 carbon atoms, and zinc aryldithiocarbamates and alkyl-substituted zinc aryldithiocarbamates having a phenyl group or an alkyl-substituted phenyl group of 1 to 18 carbon atoms.

In addition, the sulfur-based antiwear agent include phosphorothionates such as trialkyl phosphorothionates, triphenyl phosphorothionates and alkyl diarylphosphorothionates, sulfurized oils and fats, and sulfurized olefins.

These antiwear agents may be used singly or in a combination of two or more thereof. For example, in the case that ZnDTP is used, it is preferable to use a combination of the zinc primary alkyldithiophosphate having an excellent antiwear performance and anti-oxidant performance and the zinc secondary alkyldithiophosphate which is excellent to keep up these effects.

The amount of the antiwear agent to be added is usually in the range of 0 to 3% by weight, preferably 0.2 to 1.5% by weight based on the total weight of the composition.

Examples of the antioxidant include amine-based antioxidants such as alkylated diphenylamines, phenyl-α-naphthylamines and alkylated α-naphthylamines, and phenol-based antioxidants such as 2,6-di-t-butyl-4methylphenol, 4,4'-methylenebis(2,6-di-t-butylphenol), 4,4'-bis(2,6-di-t-butylphenol), 4,4'-bis(2-methyl-6-butylphenol), 2,2'-methylenebis(4ethyl-6-t-butylphenol), 2,2'-methylenebis(4-methyl-6-t-butylphenol), 4,4'-butylidene-bis(3-methyl-6-t-butylphenol), 4,4'-thiobis(2-methyl-6-t-butylphenol), 4,4'-thiobis(3-methyl-6-t-butylphenol) and 2,2'-thiobis(4methyl-6-t-butylphenol). The amount of these antioxidants to be added is usually in the range of 0.05 to 2% by weight based on the total weight of the composition.

Examples of the viscosity index improver include polymethacrylate, dispersion type polymethacrylate, olefin-based copolymers (e.g., ethylene-propylene copolymer and the like), dispersion type olefin-based copolymers, styrene copolymers (e.g., styrene-diene hydrogenated copolymer and the like). An example of the pour point depressant is a polymethacrylate, and examples of the rust preventive include alkenylsuccinic acids and their partial esters. Examples of the metal corrosion inhibitor include materials containing benzotriazole, benzimidazole, benzothiazole and thiadiazole, and examples of the anti-foaming agent include dimethyl polysiloxane and polyacrylates, and an example of the surface active agent is polyoxyethylene alkylphenyl ether.

Next, a method for the lubrication of a diesel engine of the present invention will be described.

In this lubrication method, the above-mentioned lubricating oil composition is used as a lubricating oil in the diesel engine provided with an exhaust gas post-treatment device. FIG. 1 is a schematic view for explaining the lubrication method of the diesel engine of the present invention. A diesel engine (e.g., four cycle) 1 is provided with an exhaust gas post-treatment device 2. In the diesel engine 1, a lubricating oil 3 is used, and as a fuel, for example, a gas oil or kerosine (preferably, a sulfur content in the fuel is 0.1% by weight or less) is used, and the engine is driven to generate mechanical power.

An exhaust gas which is simultaneously generated is treated by the exhaust gas post-treating device 2 attached to the diesel engine 1, and then discharged to the outside. As the exhaust gas post-treatment device 2, there is an oxidation catalyst device or a PM trap for collecting a particulate exhaust matter in the exhaust gas.

In the drive of the diesel engine, when the lubricating oil composition of the present invention is used, excellent engine detergency and deposit-resistant properties can be exerted without impairing the performance of the exhaust gas post-treatment device, whereby the diesel engine can be lubricated.

The lubricating oil composition having a decreased 10 ash content for the diesel engine of the present invention can achieve the excellent engine detergency and deposit-resistant properties without impairing the performance of an exhaust gas post-treatment device such as a particulate exhaust matter (PM) trap or an oxidation catalyst, and so the lubricating oil composition is extremely suitable as the lubricating oil for the diesel engine provided with the exhaust gas post-treatment device.

Therefore, the method for the lubrication of the diesel engine of the present invention by the use of this lubricating oil composition can exert a sufficient effect as measures to the exhaust controls of the diesel engine.

Next, the present invention will be described in more detail with reference to examples and comparative examples, but the scope of the present invention should not be limited at all by these examples.

Amounts of components in the examples and the comparative examples will be all denoted by "% by weight". Furthermore, the performance of the lubricating oil composition was evaluated by determining engine detergency and deposit-resistant properties (a PM trap clogging ratio) in accordance with the following procedures.

(1) Engine detergency

As an engine, there was used a single cylinder four cycle diesel engine having a displacement of 300 cc for a small generator, and a wall flow type PM filter having a ceramic filter with an average pore size of 30 μm was attached to an exhaust pipe.

After driven under conditions shown in Table 1, the engine was dismantled, and detergency was evaluated at five positions of a top land, a top groove, a 2nd land, a 3rd land and an undercrown of a piston in accordance with a 10-point system, and the total points were calculated.

In this connection, for reference, with regard to a commercial API CD class diesel oil, the detergency was evaluated to be 36 points by this test method. Furthermore, the detergency of a commercial API CC class diesel oil was evaluated to be 21 points.

TABLE 1

| | |
|---|---|
| Rotational Speed (rpm) | 2,700 |
| Oil Temperature (°C.) | 120 |
| Load (N · m) | 15 |
| Test Time (hr) | 50 |
| Fuel | Gas oil having sulfur content of 0.05 wt % |

(2) PM trap clogging ratio

The same engine and PM trap as in the above-mentioned detergency test were used, and the engine was driven under conditions shown in Table 2.

Afterward, the regeneration of the PM trap was conducted at 700° C. for 3 hours by an electric heater, and the engine was driven again under the same conditions. After it was confirmed that constant conditions were reached, a pressure difference between inlet and outlet of the PM trap was measured, and the PM trap clogging ratio was then calculated in accordance with the following-formula.

*PM* trap clogging ratio (%) = [(pressure difference $\Delta P$ after drive for 200 hours − initial pressure difference $\Delta P$)/initial pressure difference $\Delta P$] × 100

TABLE 2

| | |
|---|---|
| Rotational Speed (rpm) | 2,700 |
| Oil Temperature (°C.) | 100 |
| Load (N · m) | 15 |
| Test Time (hr) | 200 |
| Fuel | Gas oil having sulfur content of 0.05 wt % |

EXAMPLES 1 TO 12 AND COMPARATIVE EXAMPLES 1 TO 5

Lubricating oil compositions were prepared in accordance with blend compositions shown in Table 3. Afterward, for each lubricating oil composition, engine detergency and a PM trap clogging ratio were measured to evaluate its performance, and a sulfated ash content (which was measured in accordance with JIS K-2272) and a boron content were also measured. The results are shown in Table 4.

TABLE 3 (I)

| | Example | | | | | |
|---|---|---|---|---|---|---|
| | 1 | 2 | 3 | 4 | 5 | 6 |
| Blend Composition (wt %) | | | | | | |
| Base Oil | | | | | | |
| 150N Mineral Oil | 84.0 | 84.0 | 86.0 | 84.0 | — | 75.0 |
| Poly(α-olefin)[1] | — | — | — | — | 84.0 | — |
| ZnDTP (pri, sec)[2] | 1.0 | 1.0 | 1.0 | 1.0 | 1.0 | 1.0 |
| Imide | | | | | | |
| Boron-containing Imide A[3] | 10.0 | 10.0 | 10.0 | — | 10.0 | 10.0 |
| Boron-containing Imide B[4] | — | — | — | 10.0 | — | — |
| Monoimide[5] | — | — | — | — | — | — |
| Metal-type Detergent | | | | | | |
| 15 TBN[8] Ca sulfonate | — | 5.0 | — | 5.0 | 5.0 | 14.0 |
| 70 TBN Ca phenate | 5.0 | — | — | — | — | — |
| 170 TBN Ca salicylate | — | — | 3.0 | — | — | — |
| 200 TBN Ca oulfonate | — | — | — | — | — | — |
| Ester | | | | | | |
| Ester 1[6] | — | — | — | — | — | — |
| Ester 2[7] | — | — | — | — | — | — |

-continued

TABLE 3 (II)

| | Example | | | | | |
|---|---|---|---|---|---|---|
| | 7 | 8 | 9 | 10 | 11 | 12 |
| Blend Composition (wt %) | | | | | | |
| Base Oil | | | | | | |
| 150N Mineral Oil | 88.5 | 87.99 | 87.99 | 87.5 | 84.0 | 89.0 |
| Poly(α-olefin)[1] | — | — | — | — | — | — |
| Zn/DTP (pri, sec)[2] | 1.0 | 1.0 | 1.0 | 1.0 | 1.0 | 1.0 |
| Imide | | | | | | |
| Boron-containing Imide A[3] | 10.0 | 8.0 | 8.0 | 8.0 | 8.0 | 5.0 |
| Boron-containing Imide B[4] | — | — | — | — | — | — |
| Monoimide[5] | — | — | — | — | — | — |
| Metal-type Detergent | | | | | | |
| 15 TBN[8] Ca sulfonate | — | — | — | — | — | — |
| 70 TBN Ca phenate | — | — | — | — | 4.0 | 5.0 |
| 170 TBN Ca salicylate | — | — | — | — | — | — |
| 200 TBN Ca sulfonate | 0.5 | 0.01 | 0.01 | 0.5 | — | — |
| Ester | | | | | | |
| Ester 1[6] | — | 3.0 | — | 3.0 | 3.0 | — |
| Ester 2[7] | — | — | 3.0 | — | — | — |

TABLE 3 (III)

| | Comparative Example | | | | |
|---|---|---|---|---|---|
| | 1 | 2 | 3 | 4 | 5 |
| Blend Composition (wt %) | | | | | |
| Base Oil | | | | | |
| 150N Mineral oil | 49.0 | 86.0 | 84.0 | 89.0 | 92.0 |
| Polyla-olefin)[1] | — | — | — | — | — |
| ZnDTP (pri, Sec)[2] | 1.0 | 1.0 | 1.0 | 1.0 | 1.0 |
| Imide | | | | | |
| Boron-containing Imide A[3] | 10.0 | 10.0 | — | 10.0 | 2.0 |
| Boron containing Imide B[4] | — | — | — | — | — |
| Monoimide[5] | — | — | 10.0 | — | — |
| Metal-type Detergent | | | | | |
| 15 TBN[8] Ca sulfonate | 40.0 | — | 5.0 | — | — |
| 70 TBN Ca phenate | — | — | — | — | 5.0 |
| 170 TBN Ca salicylate | — | — | — | — | — |
| 200 TBN Ca sulfonate | — | 3.0 | — | — | — |
| Ester | | | | | |
| Ester 1[6] | — | — | — | — | — |
| Ester 2[7] | — | — | — | — | — |

[Notes]

[1]Poly(α-olefin): Kinematic viscosity at 100° C. = 10 cSt

[2]ZnDTP (primary, secondary)

pri.:sec. = 9:2 (P content)

[3]Boron-containing imide A:

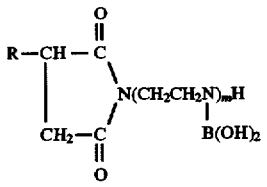

R: A polybutenyl group having a molecular weight of 1,000

[4]Boron-containing imide B:

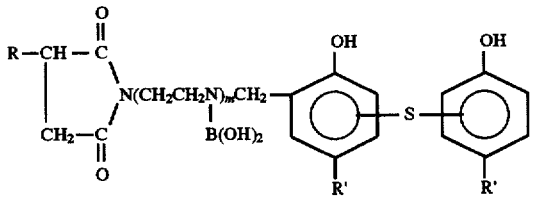

R: A polybutenyl group having a molecular weight of 1,000

R': An alkyl group having 16 carbon atoms.

[5]Monoamide:

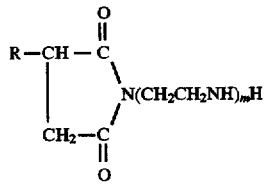

R: A polybutenyl group having a molecular weight of 1,000

[6]Ester 1: Dodecylsalicylic acid dodecylphenyl ester

[7]Ester 2: Dodecylsalicylic acid glycol ester

[8]TBN: Total base number (a perchloric acid method, mg KOH/g)

TABLE 4

| | Boron Content (wt %) | Sulfated Ash Content (wt %) | Engine Clearning Properties MR | PM Trap Clogging Ratio (%) |
|---|---|---|---|---|
| Example 1 | 0.20 | 0.72 | 43 | 6 |
| Example 2 | 0.20 | 0.55 | 40 | 4 |
| Example 3 | 0.20 | 0.91 | 38 | 7 |
| Example 4 | 0.16 | 0.48 | 43 | 3 |
| Example 5 | 0.20 | 0.55 | 41 | 4 |
| Example 6 | 0.20 | 0.98 | 42 | 8 |
| Example 7 | 0.20 | 0.50 | 37 | 3 |
| Example 8 | 0.16 | 0.28 | 41 | 2 |
| Example 9 | 0.16 | 0.28 | 40 | 2 |
| Example 10 | 0.16 | 0.47 | 38 | 3 |
| Example 11 | 0.16 | 0.64 | 44 | 5 |
| Example 12 | 0.10 | 0.86 | 36 | 7 |
| Comp. Ex. 1 | 0.20 | 2.3 | 41 | 20 |
| Comp. Ex. 2 | 0.20 | 1.1 | 23 | 10 |
| Comp. Ex. 3 | 0 | 0.40 | 20 | 3 |
| Comp. Ex. 4 | 0.20 | 0.31 | 20 | 3 |
| Comp. Ex. 5 | 0.04 | 0.58 | 20 | 4 |

What is claimed is:

1. A lubricating oil composition for a diesel engine which is obtained by blending a lubricant base oil with (A) 5 to 20% by weight of a boron-containing ashless dispersant, (B) 0.01 to 30% by weight of at least one kind of metal-type detergent selected from the group consisting of sulfonates, phenates and salicylates having a total base number (a perchloric acid method) of 0 to 200 mg KOH/g, and (C) 0.1 to 30% by weight of an ester of an aromatic carboxylic acid having a hydroxyl group and an alcohol having 2 to 80 carbon atoms, based on the total weight of the composition, a sulfated ash content in the composition being 1.0% by weight or less, a boron content being 0.1% by weight or more.

2. The lubricating oil composition for a diesel engine according to claim 1 wherein the lubricant base oil is a mineral oil, a synthetic oil or a mixture thereof having a kinematic viscosity of 1.5 to 30 cSt at 100° C.

3. The lubricating oil composition for a diesel engine according to claim 1 wherein the boron-containing ashless dispersant of the component (A) is a boron-containing alkenylsuccinimide, a boron-containing alkylsuccinimide or a mixture thereof.

4. The lubricating oil composition for a diesel engine according to claim 1 wherein the component (C) is an ester of an aromatic carboxylic acid having a hydroxyl group and an alkyl-substituted aromatic alcohol.

5. The lubricating oil composition for a diesel engine according to claim 1 wherein the aromatic carboxylic acid having the hydroxyl group in the component (C) is represented by the general formula (I)

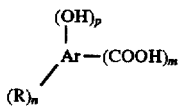

(I)

wherein Ar is a polyvalent aromatic nucleus; R is an organic group; p is an integer of 1 to 3; n is an integer of 1 to 4; m is an integer of 1 to 3; when n is plural, the plural Rs may be identical or different.

6. The lubricating oil composition for a diesel engine according to claim 1 wherein a boron content is in the range of 0.1 to 1.2% by weight.

7. A method for the lubrication of a diesel engine which comprises the step of lubricating a diesel engine provided with an exhaust gas-post treatment device with a lubricating oil composition of any one of claims 1 to 6.

* * * * *